US006230637B1

(12) United States Patent
Wengerter et al.

(10) Patent No.: US 6,230,637 B1
(45) Date of Patent: May 15, 2001

(54) SEWING INSTALLATION FOR THE PRODUCTION OF A PIPED POCKET OPENING

(75) Inventors: Karl-Heinz Wengerter, Grosswallstadt; Bernd Rausch, Hösbach; Klaus Seufert, Grosswallstadt, all of (DE)

(73) Assignee: Beisler GmbH (DE)

( * ) Notice: Subject to any disclaimer, the term of this patent is extended or adjusted under 35 U.S.C. 154(b) by 0 days.

(21) Appl. No.: 09/515,160

(22) Filed: Feb. 29, 2000

(30) Foreign Application Priority Data

Mar. 2, 1999 (DE) ..... 199 08 894

(51) Int. Cl.[7] ..... D05B 3/10; D05B 37/06; D05B 37/08

(52) U.S. Cl. ..... 112/68; 112/129; 112/470.05

(58) Field of Search ..... 112/68, 65, 129, 112/130, 470.05, 163, 70, 76, 67

(56) References Cited

U.S. PATENT DOCUMENTS 6,047,654 * 4/2000 Kaufhold ..... 112/68 X
6,095,072 * 8/2000 Kaufhold ..... 112/470.05

FOREIGN PATENT DOCUMENTS 42 24 034 A1 1/1993 (DE) .

* cited by examiner

*Primary Examiner*—Peter Nerbun
(74) *Attorney, Agent, or Firm*—Robert F. I. Conte; Lee, Mann, Smith, McWilliams, Sweeney & Ohlson

(57) ABSTRACT

A sewing installation for the production of a piped pocket opening in a cloth workpiece comprises two cutting units each with a corner cutting knife, which have two knives each. For the production of straight or diagonal corner cuts, one knife of a corner cutting knife is pivotally adjustable about an axis in the direction of the incision which substantially constitutes the pocket opening.

11 Claims, 4 Drawing Sheets

2
31
a
97
113
108
111
(9)
105
127
(10)
X
Y
106
109
98
l
103
104
126
107
110
112
114
96
27
28
41

31
131
130
131''
132
130''
120
122
100
W3
117
130'
124
105
128
131'
115
101
l
103
118
104
127
121
116
W2
99
119
123
125

SEWING INSTALLATION FOR THE PRODUCTION OF A PIPED POCKET OPENING

BACKGROUND OF THE INVENTION

1. Field of the Invention

The invention relates to a sewing installation for the production of a piped pocket opening on a cloth workpiece.

2. Background Art

U.S. Pat. No. 3,747,545 teaches a sewing apparatus for the formation of a piped pocket opening on a cloth workpiece which comprises a working plate, a two-needle sewing machine disposed on the working plate, and a workpiece advancing device for the transport of the workpiece in a Y-direction on the working plate. Furthermore, a knife is available for the production of a straight incision in the Y-direction in the workpiece during transport in the Y-direction. A cutout, which extends in the Y-direction, is formed in the working plate. Underneath the working plate, provision is made for a cutting device for the production of corner cuts, the cutting device comprising two corner cutting knives. Each corner cutting knife consists of two blades. For the production of so-called diagonal corner cuts which are necessary in diagonal pocket openings, the corner cutting knives are of pivotal design. This kind of adjustment of the corner cutting knives permits only a comparatively restricted influence on the feasible corner cuts; therefore, this type of knife adjustment has not been successful in practice. Moreover the structure is very complicated. Any adjustment of the corner cutting knives can be triggered only in constructionally defined stages. The known cutting device is accompanied with considerable requirements in terms of assembly, adjustment and fabrication.

U.S. Pat. No. 3,820,481 teaches a sewing apparatus for the production of a piped pocket opening on a cloth workpiece, the pocket opening being alternatively straight or diagonal. It comprises a cutting device with corner cutting knives which consist of two individual knives. Variability of the angles of the corner cuts at the respective end of the pocket opening is attained in that on the one hand the corner cutting knives are rotatable in defined given stages and in that moreover the two knives of a corner cutting knife penetrate into the workpiece by varying depths. The known design is constructionally complicated and correspondingly costly. Assembly and adjustment are also accompanied with considerable time expenditure. Moreover, the angles of the corner cuts can only be triggered in given stages. Since these knives penetrate into the workpiece by varying depths, the cutting lengths in the corner cut depend on the material.

U.S. Pat. No. 5,400,731 teaches a sewing system for the production of a piped pocket opening on a cloth workpiece, which fundamentally corresponds to that according to U.S. Pat. No. 3,820,481 described above. In this case, however, rotation of the knives takes place by means of stepping motors that can be triggered continuously, and the cutting motion of the knives is effected by pneumatically actuated piston-cylinder drives. The drawbacks are fundamentally the same as described above.

A sewing apparatus is known from DE 42 24 034 A1, having a cutting device for the production of corner cuts. The corner cutting knives are drivable by means of electric motors, each knife of a corner cutting knife being adjustable to varying cutting strokes and angles for corner cuts of varying angles and cutting lengths to be carried out. Correspondingly, each corner cutting knife is provided with four motors so that the cutting device, which comprises two corner cutting knives, has a complicated design. In this case, too, there is the drawback that the cutting lengths in the corner cut depend on the material due to the varying depths of penetration of the knives.

SUMMARY OF THE INVENTION

It is an object of the invention to embody a sewing installation for the production of a piped pocket opening on a workpiece, in which adjustment of the corner cutting knives is feasible at a low construction cost and in which steady quality of the corner cuts is ensured.

This object is attained in a sewing installation for the production of a piped pocket opening on a workpiece, comprising a working plate; a two-needle sewing machine disposed on the working plate; a workpiece advancing device for the transport of the workpiece in a Y-direction on the working plate; a knife for the production of a straight incision running in the Y-direction in the workpiece during the transport thereof in the Y-direction; a cutout running in the Y-direction in the working plate; a cutting device for the production of corner cuts in the workpiece, which cutting device is disposed underneath the cutout of the working plate, comprises a first and a second cutting unit, which are adjustable relative to each other in the Y-direction, and a drive for the adjustment relative to each other of the first and the second cutting unit; a first corner cutting knife, which is disposed on the first cutting unit, and a second corner cutting knife, which is disposed on the second cutting unit, each of the first and second corner cutting knives comprising a first knife, a second knife, and a cutting point, at least one knife being adjustable in a pivot guide to pivot about an axis which intersects the cutting point and runs in an X-direction; at least one drive disposed on the first and the second cutting unit for the displacement of the corner cutting knives by a uniform stroke in a Z-direction through the cutout in the working plate and through the workpiece resting thereon; at least one drive disposed on each cutting unit for the pivotal adjustment of at least one knife relative to the cutting unit; and a control unit for the triggering of the drives. The pivotal adjustment of one or preferably of both knives of a corner cutting knife only serves to change the position of the cutting edges. The tips of the cutting edges remain in a common point which can be formed by a cutting point for instance of an awl or by the tips of the knives themselves. These adjustments serve to modify the length of the cuts to be performed at a constant cutting stroke and the angular position of the cuts relative to each other. Owing to the uniform depth of incision of the knives, simple actuation, for instance by pneumatically actuated piston-cylinder drives, is possible at a constant stroke. The design is simple, which keeps the number of components low.

Details of the invention will become apparent from the ensuing description of an exemplary embodiment of the invention, taken in conjunction with the drawing.

Figure 6:
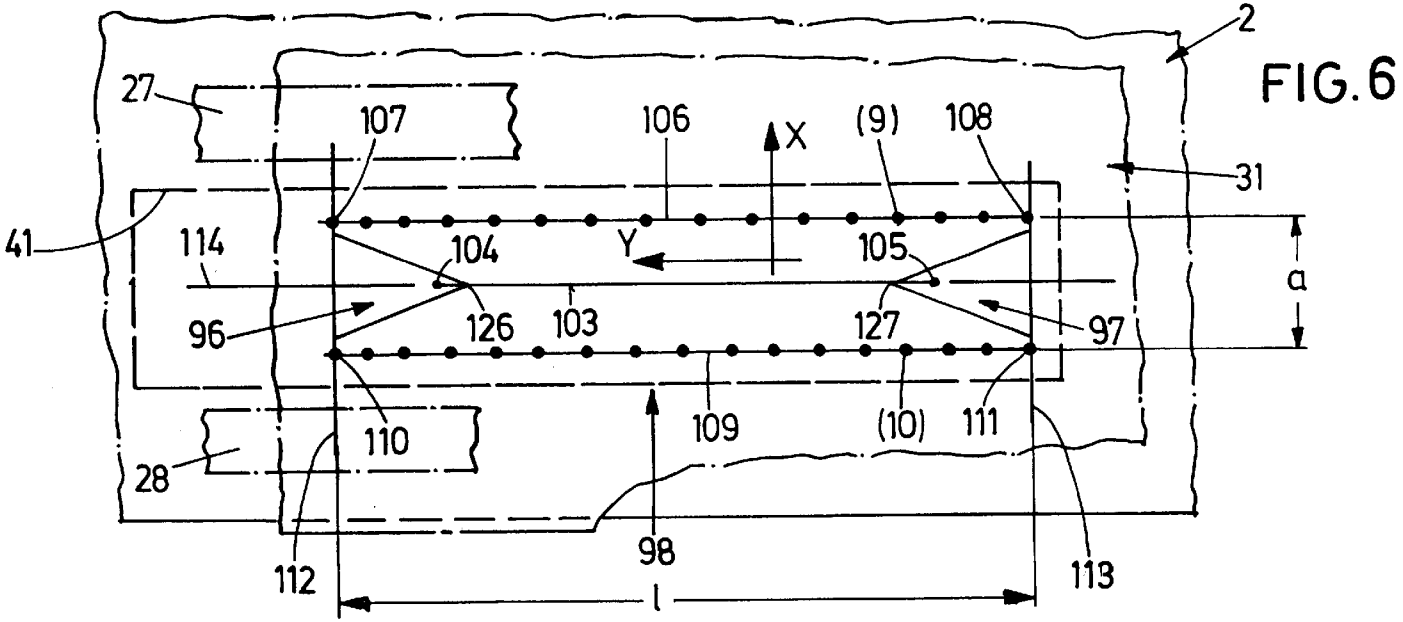
FIG. 6 is a plan view of a workpiece lying on a working plate and having straight corner cuts which are symmetric relative to each other.

A sewing installation 1 is provided with a working plate 2 which extends approximately on a horizontal plane that is defined by X- and Y-directions of an extension at right angles to each other. A two-needle sewing machine 3 is fixed by its base plate 4 on the working plate 2. The two-needle sewing machine 3 generally has an arm 5 which terminates in a head 6. In the head 6, provision is made for a crank drive (not shown) for the actuation of two needle bars 7, 8, which can be switched on and off individually and in each of which a needle 9, 10 is fixed. The needles 9, 10 are disposed at a distance a of for instance 12 mm from each other in the X-direction as seen in FIG. 6 where the reference numerals of the needles 9, 10 are roughly outlined in parentheses.

A knife 11 is disposed above the working plate 2 on the head 6 between the needles 9, 10 and centrally relative thereto referred to the X-direction and is movable up and down in a Z-direction of an extension at right angles to the X- and Y-directions by means of a drive (not shown) that is disposed in the head 6. The knife can be moved into an upper position of rest and a lower working position. In the position of rest (FIG. 1), the knife 11 is above the working plate 2; for the performance of a cutting motion, it makes an up and down movement in the direction of the Z-axis.

The two-needle sewing machine 3 further comprises a handwheel 12 which is connected with a drive motor 14 via a belt drive 13. The drive motor 14 combines with a motor control (not shown nor described) to form a unit. In combination with the motor control, the drive motor 14 is a commercial sewing machine drive which permits to actuate and stop the two-needle sewing machine 3 in a defined way so that switching the two needle bars 7, 8 on and off and switching the knife 11 on and off is performed by the aid of integrated miscellaneous functions. In the vicinity of the handwheel 12, the two-needle sewing machine 3 is provided with a support arm 15, to the free end of which is fixed a control panel 16 with operating elements 17.

A plate 18 is mounted on the arm 5 of the sewing machine 3 and thereafter in the Y-direction; the plate 18 is joined to a guide 19 constituted by two guide rods which are parallel to each other and on which a carriage 20 lodges for reciprocating displacement in the Y-direction. The carriage 20 is further provided with a bearing 21, in which a double-armed lever 22 lodges pivotally. An arm 23 of the lever 22 is articulated to one end of a piston-cylinder drive 24, which can be actuated pneumatically and the other end of which lodges pivotally on the carriage 20. A workpiece advancing device 26, which comprises a first clamping-plate member 27 and a second clamping-plate member 28, is mounted on the free end of the other arm 25 of the lever 22. This arrangement ensures that, by actuation of the drive 24, the lever 22 can be pivoted into a lowered working position 29 and an elevated position of rest 30. The described construction is such that a cloth workpiece 31 placed on the working plate 2 is clamped and fixed by the clamping-plate members 27, 28 and, upon displacement of the carriage 20, is displaced in the Y-direction by the clamping-plate members 27, 28 as a result of function. Finally attention is drawn to the fact that the free end of the guide 19 that is opposed to the plate 18 is joined to a plate 32 which is in turn joined for stabilization to the plate 18 via a rod 33.

Figure 1:
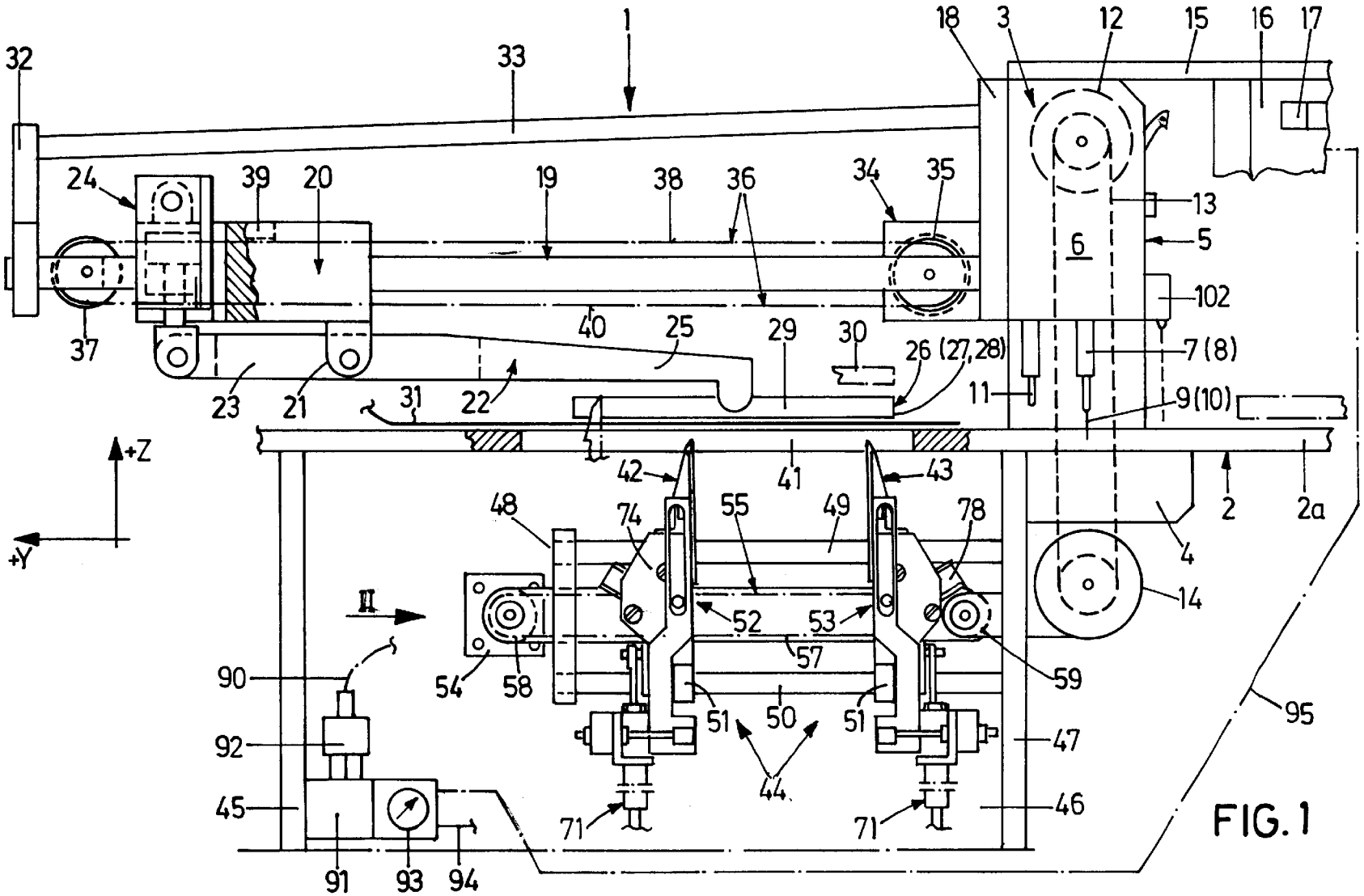
FIG. 1 is a front view of a sewing installation with a cutting device comprising two cutting units.

According to FIG. 1, an electric drive motor 34 in the form of a stepping motor is mounted on the plate 18 after the guide 19 in the X-direction, comprising a timing-belt pulley 35 that is turned towards the carriage 20. The timing-belt pulley 35 is encircled by a continuous timing belt 36 which also encircles a timing-belt pulley 37 that is mounted for rotation on the plate 32. The upper strand 38 of the timing belt 36 is joined to the carriage 20 by means of a clamping device 39 disposed on the carriage 20, whereas the lower strand 40 is movable relative to the carriage 20. As a result of the design specified, the carriage 20, and along with it the clamping plate 26, can be displaced by the drive motor 34 to reciprocate on the guide 19 in the positive and negative Y-direction.

As seen in FIGS. 1 and 6, the working plate 2 is provided with a rectangular cutout 41, which extends in the Y-direction in such a way that—as described below—corner cutting knives 42, 43 disposed underneath the working plate 2 are displaceable upwards in the Z-direction through the working plate 2 without being impeded. Attention is drawn to the fact that the working plate 2 is also provided with corresponding recesses for the knives 11 and the needles 9, 10 to pass through downwards.

The design described so far of the sewing installation 1 is known from U.S. Pat. No. 5,400,731, to which reference is made for further details.

The corner cutting knives 42, 43 are components of a cutting device 44 which is described in detail in the following, in particular with reference to FIGS. 1 to 6. The working plate 2 supports itself on a stand formed by walls 45, 46 and 47 and is tightly joined thereto. Mounted on the rear wall 46 and the lateral wall 47—which is the right wall in FIG. 1—is a guide arrangement 48 substantially composed of two guide rods 49, 50 which are disposed in a common vertical Y-Z-plane and run parallel to each other in the Y-direction. Disposed on these guide rods 49, 50 are two carriages 5 1, on each of which is mounted a cutting unit 52, 53, each cutting unit 52, 53 having the corner cutting knife 42 and 43, respectively. A drive motor 54 in the form of a stepping motor is fixed by the side of the guide arrangement 48 in the rear wall 46; by means of a timing belt drive 55, the drive motor 54 can move the carriage 51 on the guide arrangement 48 in the Y-direction, the carriage 51 carrying the cutting unit 52 which is illustrated on the left in FIG. 1. To This end—as seen in particular in FIG. 2—a driver 56, which is joined to the timing belt 57, is mounted on the carriage 51 of the cutting unit 52. This tiling belt 57 is guided via a timing belt pinion 58 which is mounted on the drive motor 54 and via a deflection pulley 59 which is supported on the rear wall 46. The carriage 51, which carries the other cutting unit 53, is fixed on the guide arrangement 48, i.e. it is not displaceable in the Y-direction.

The cutting units 52, 53 are identical, which is why only the cutting unit 52 is described.

A guide rail 69, which runs in the Z-direction and to the lower end of which is fixed a support 61, is screwed on a horizontally projecting supporting section 60 of the carriage 51. Guide members 64, 65, which stand upwards in the Z-direction, are mounted on the support 61 for displacement in the Y-direction in guide rails 62, 63 which run in the Y-direction. For the displacement of each guide member 64, 65, a stepping motor 66, 67 is mounted on the support 61, having a spindle nut drive 68. The spindle nut drive 68 is connected to the corresponding stepping motor 66 or 67 on the one hand and to the guide member 64 or 65 on the other, as seen in particular in FIGS. 3 and 4.

Further, a sliding bearing 70 is mounted for vertical displacement on the guide rail 69. This sliding bearing 70 is vertically displaceable by means of a linear drive 71 in the form of a pneumatically actuated piston-cylinder drive, the cylinder 72 of which is mounted on the support 61 and the piston rod 73 of which is articulated to the sliding bearing 70.

Figures 2, 5:
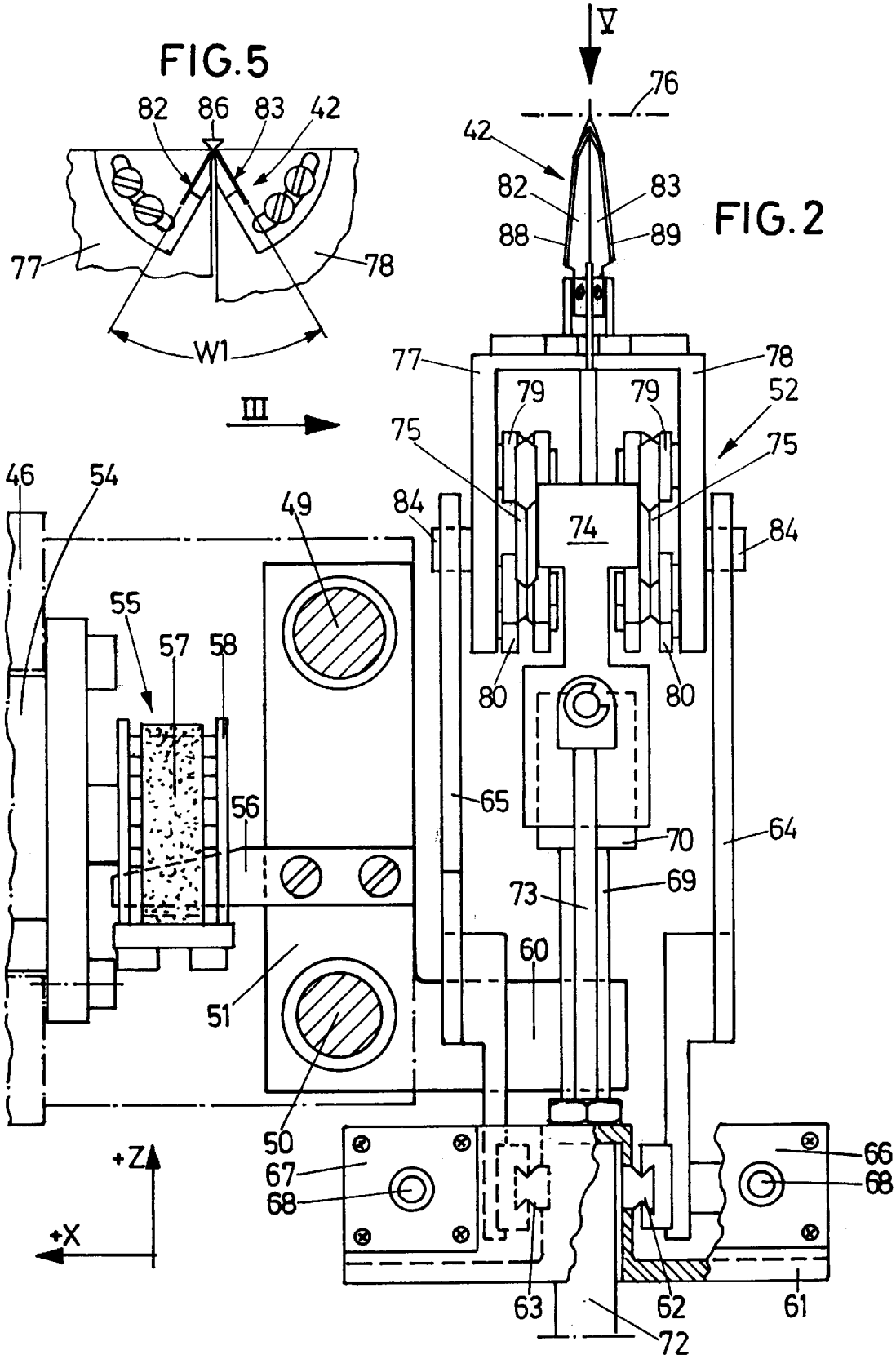
FIG. 2 is a view of a cutting unit in accordance with the arrow II of FIG. 1 on an enlarged scale as compared to FIG. 1.
FIG. 5 is a plan view of a corner cutting knife in accordance with the arrow V of FIG. 2.

Connected to the sliding bearing 70 is a support member 74, on both sides of which, i.e. in a manner tuned towards the guide members 64, 65, is mounted a guide rail 75 in the shape of a section of a circular ring. The two guide rails 75 have a center of curvature which lies on a common virtual axis of rotation 76 which runs in the X-direction. On the guide rails 75, a pivotal angular knife carrier 77, 78 is pivotally guided by means of in each case three rolls 79, 80, 81. Each guide rail 75 combines with rolls 79, 80, 81, which guide it, to form a pivot guide. As seen in FIG. 5, two exchangeable and adjustable cutting knives 82, 83 are located on each knife carrier 77, 78. The two knives 82, 83 at a time form a corner cutting knife 42 and 43, respectively. As seen in FIG. 5, the knives 82, 83 of a corner cutting knife 42 and 43 are adjustable for the angle W1 they enclose to be modifiable. By reason of the mounting of the knife carriers 77, 78 by means of the rolls 79, 80, 81, the cutting knives 82, 83 can be pivoted individually about the common axis of rotation 76.

Mounted on the respective knife carrier 80, 81 is a guide roll 84 which engages, nearly without play in the Y-direction, with an oblong guide hole 85 which extends in the Z-direction and is mounted on the respective guide member 64 and 65, respectively.

Further, a so-called awl 86 is mounted on the support member 74, having a cutting point 87 which simultaneously lies in the axis of rotation 76. This cutting point 87 is followed by the cutting edges 88, 89 of the knives 82, 83. The cutting point 87 is part of the corner cutting knife 42 and 43, respectively. The cutting device 44 is equipped with several drives, namely two pneumatic drives 71 of constant and identical stroke, two times two stepping motors 66, 67 and the stepping motor 54. Via a line 90, the drives are connected to a switch box 91 which is fixed to the wall 46. The line 90 comprises electric and pneumatic connection lines to the mentioned drives. The line 90 is connected to the switch box 91 via an interface in the form of a plug connection 92 so that docking the line 90 to, or separating it from, the switch box 91 is easily possible without any special expenditure of time. The switch box 91 is further connected to a maintenance unit 93, to which compressed air is fed from a source via a line 94. The maintenance unit 93 serves for the preparation (cleaning, lubricating and pressure adjustment) of the compressed air originating from the source. Solenoid valves are also disposed in the switch box 91, pneumatically actuating the drives 71. Furthermore, the switch box 91 is connected via an electric line 95 to the control panel 16 which also accommodates a control unit (FIG. 1).

Figure 7:
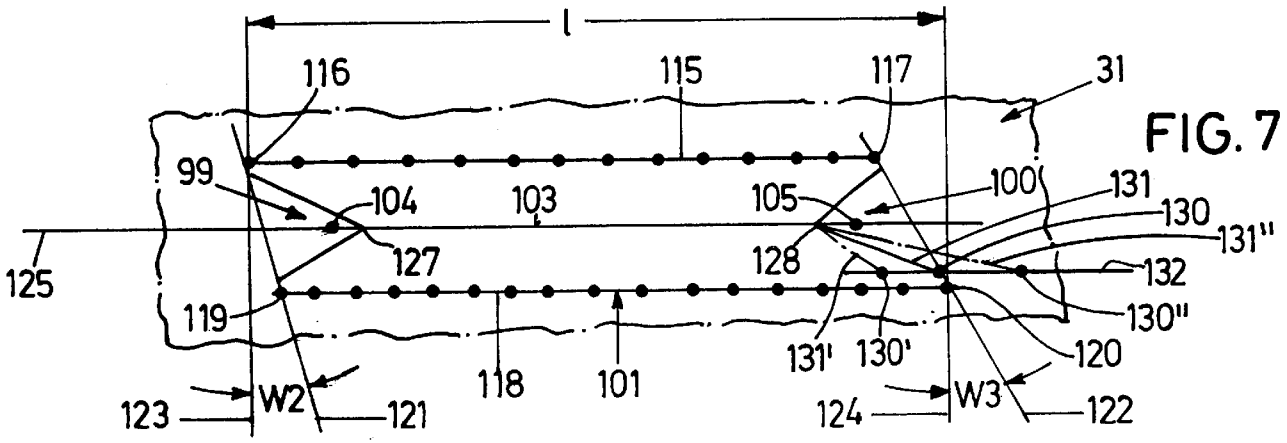
FIG. 7 is a plan view, corresponding to FIG. 6, on a workpiece with diagonal corner cuts.

The mode of operation of the cutting device 44 is as follows: first the control system is supplied with information on the length 1 (FIG. 6) and the shape of a pocket opening 98 to be produced. Specifying the shape comprises information on whether a pocket opening 98 provided with straight corner cuts 96, 97 is to be produced in the workpiece 31 (FIG. 6) or whether a pocket opening 101 is to be produced which has corner cuts 99, 100 that are diagonal by given angles W2, W3 in a workpiece 31 (FIG. 7).

This information can be fed to the control unit by manual entry at the control panel 16 or automatically. Automatic feed of information takes place for example when a flap (not shown) is to be sewn on additionally in the vicinity of the pocket opening 98 and 101. In this case, detection of the first and second edge of the flap takes place automatically by means of a light barrier unit 102 disposed on the head 6 of the two-needle sewing machine 3, which means the supply to the control unit of information that represents the angles W2, W3 inclusive of the length 1, to be produced, of the pocket opening 101.

The example according to FIG. 6 proceeds from the assumption that the workpiece 31, which is clamped on the working plate 2 by the clamping-plate members 27, 28 by means of the drive 24, is in a position according to FIGS. 1 and 6, covering the cutout 41. It further proceeds from the assumption that the workpiece 31 possesses an incision 103 produced by the knife 11 and having final points 104, 105; a seam 106 produced by the two-needle sewing machine 3 and having final points 107, 108; and a seam 109 running in parallel thereto and having final points 110, 111. The positions of the mentioned final points 107, 108 and 110, 111 of the seams 106, 109 relative to the final points 104, 105 of the incision 103 correspond to the information supplied to the control unit. The final points 107, 110 define a straight line 112 and the final points 108, 111 define a straight line 113 which is parallel thereto. The straight lines 112, 113 run at right angles to a line 114 which extends through the incision 103 and which reflects the working direction of the sewing installation 1.

Based on the described information, the control unit causes the stepping motor 54 to be triggered, whereby the cutting unit 52 is moved into a position relative to the cutting unit 53 that defines the desired length 1 of the pocket opening 101 to be produced. Further, the control unit initiates the triggering of the stepping motors 66, 67 which are contained in the cutting units 52, 53 of the cutting device 44. Via the spindle nut drive 68, the respective stepping motor 66, 67 exercises a motion in the positive or negative Y-direction depending on the direction of rotation, whereby the guide member 64 or 65, which is coupled to the respective spindle nut drive 68, is displaced correspondingly. The corresponding knife carrier 77 or 78 is entrained by the guide member 64 or 65, respectively, via the corresponding guide roll 84 and is pivoted about the virtual axis of rotation 76 by reason of its lodging on the respective guide rail 75. The cutting point 87 of the awl 86 remains in its position; however, the cutting edges 88, 89 of the cutting knives 82 and 83, respectively, obtain a varying position in the X-Y-plane. The drawing, in particular FIG. 5, illustrates how the knives 82, 83 of a corner cutting knife 42 are adjusted symmetrically of each other for the production of a straight corner cut 96 and 97, respectively.

After the adjustment of the knives 82, 83 of each corner cutting knife 42 and 43, respectively, the stepping motors 66, 67 are stopped. Since they and the spindle nut drives 68 are self-locking, the position of each cutting knife 82, 83 is fixed.

Figure 4:
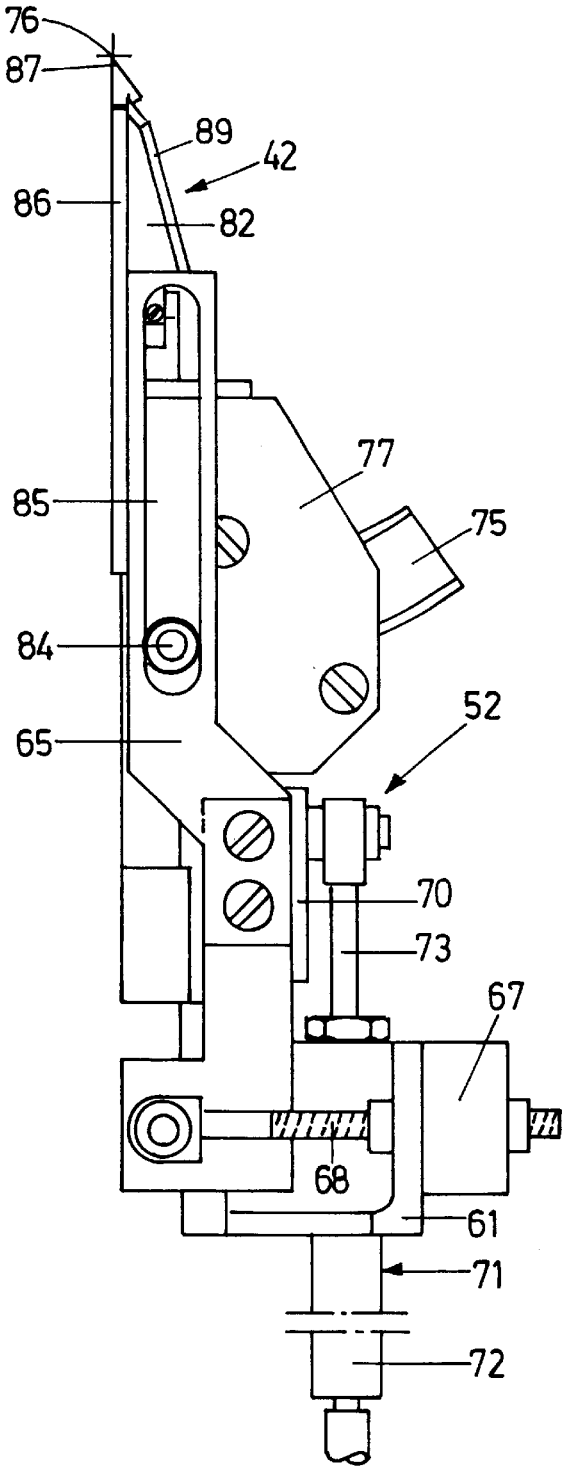
FIG. 4 is an illustration of the cutting unit seen in FIG. 3 with the corner cutting knife lowered in the position of rest.
Figure 3:
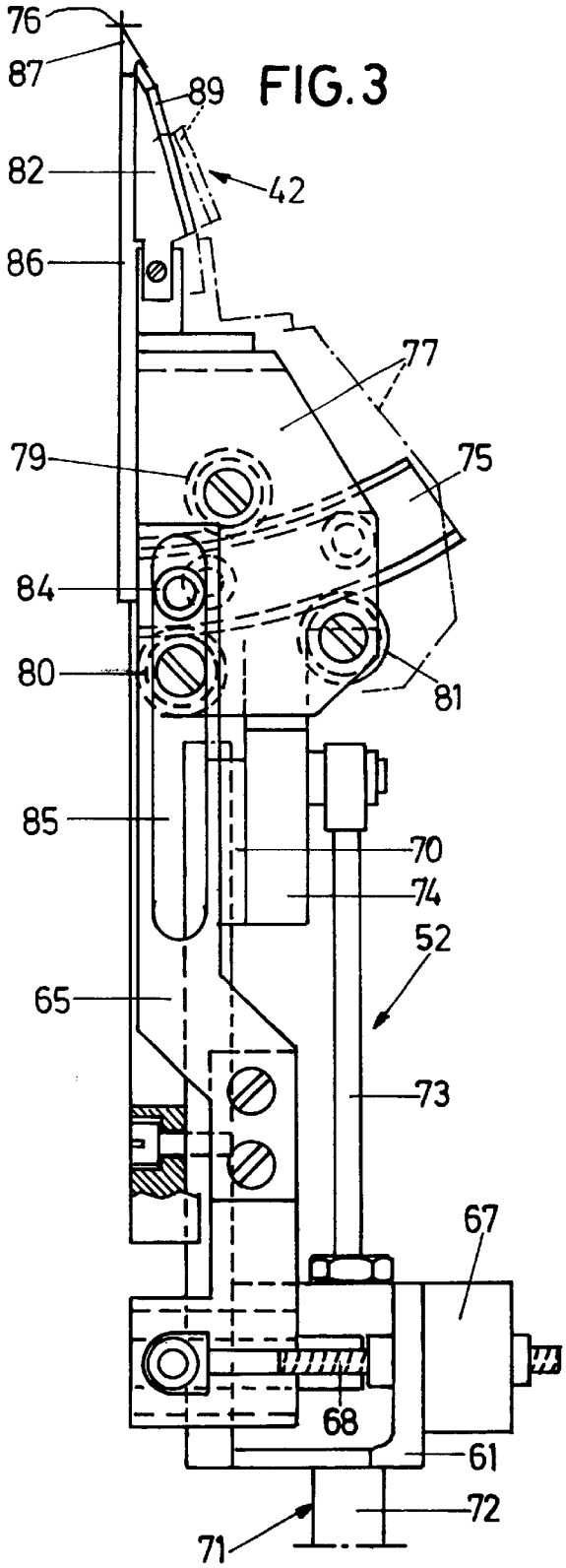
FIG. 3 is a lateral view of the cutting unit in accordance with the arrow III of FIG. 2, in an illustration partially broken away, with the corner cutting knife in an elevated position of working.

Subsequently, the linear drives 71 are triggered automatically, whereby the respective support member 74 with the two associated knife carriers 77, 78 with the corner cutting knives 42 and 43, respectively, is moved from a position of rest seen in FIG. 4 at the bottom into a position seen in FIG. 3 at the top, the corner cutting knives 42, 43 passing through the cutout 41 and a straight corner cut 96, 97 being carried out in the workpiece 31, corresponding to the position of the cutting edges 88, 89, as seen in FIG. 6. The clamping-plate members 27, 28 retain the workpiece 31 on the working plate 2. Then the control unit causes a reversal of the linear drives 71 so that the finished workpiece 31 can be removed after disengagement of the clamping-plate members 27, 28.

The production of the pocket opening 101 with the corner cuts 99, 100 which are diagonal by the angles W2 and W3 is explained in the following, based on FIG. 7.

As specified in connection with the working of the workpiece 31 according to FIG. 6, the workpiece 31 according to FIG. 7 comprises an incision 103 with final points 104, 105; a seam 115 parallel thereto and with the final points 116, 117; and a seam 118 which is parallel to the incision 103 and the seam 115 and has the final points 119, 120. The final points 116, 120 define the entire length 1 of the pocket opening 101.

The final points 116, 119 define a straight line 121 and the final points 117, 120 define a straight line 122. The straight line 121 cooperates with a straight line 123 to enclose the angle W2 and the straight line 122 cooperates with a straight line 124 to enclose the angle W3. The straight lines 123, 124 run through the outermost final points 116 and 120 of the seams 115 and 118 and at right angles to the line 125 which is defined by the incision 103 and which, as the line 114, defines the working direction of the sewing installation 1.

As described above, for the production of these diagonal corner cuts 99, 100, the knives 82, 83 of each corner cutting knife 42, 43 are adjusted by being pivoted relative to each other by means of the stepping motors 66, 67. It is important that, whatever the adjustment of the two knives 82, 83 of a corner cutting knife 42 and 43, the cutting edges 88, 89 coincide in a common point so that they will always carry out a corner cut 96 and 97 or 99 and 100, respectively, in which the cuts run into each other corresponding to the illustration in FIGS. 6 and 7, respectively, i.e. they meet. The respective point 126, 127 of each corner cut 96, 97 (FIG. 6) or the point 128, 129 of each diagonal corner cut 99, 100 (FIG. 7) is maintained regardless of the position of the knives 82, 83 of each corner cutting knife 42, 43. As seen in FIG. 7 lower right, depending on the pivoted adjustment of the associated knife 82 and 83, the final point 130, turned away from the point 128, of each individual cut 13 of a knife 82 and 83 migrates on a straight line 132 between the final points or final positions 130' and 130", depending on the pivoted adjustment; the straight line 132 is parallel to the incision 104. The end positions defined by the final points 130' and 130", respectively, are roughly outlined by the dot-dashed lines 131' and 131".

Fundamentally, it is also possible to work without the awl 86, when the knives 82, 83 have distinctly coinciding points.

What is claimed is:

1. A sewing installation for the production of a piped pocket opening (98, 101) on a workpiece (31), comprising a working plate (2);

a two-needle sewing machine (3) disposed on the working plate (2);

a workpiece advancing device (26) for the transport of the workpiece (31) in a Y-direction on the working plate (2);

a knife (11) for the production of a straight incision (103) running in the Y-direction in the workpiece (31) during the transport thereof in the Y-direction;

a cutout (41) running in the Y-direction in the working plate (2);

a cutting device (44) for the production of corner cuts (96, 97; 99, 100) in the workpiece (31), which cutting device (44)

is disposed underneath the cutout (41) of the working plate (2), comprises a first and a second cutting unit (52, 53), which are adjustable relative to each other in the Y-direction, and a drive (54) for the adjustment relative to each other of the first and the second cutting unit (52, 53);

a first corner cutting knife (43), which is disposed on the first cutting unit (52), and a second corner cutting knife (42), which is disposed on the second cutting unit (53), each of the first and second corner cutting knives (43, 42) comprising a first knife (82), a second knife (83), and a cutting point (87), at least one knife (82, 83) being adjustable in a pivot guide to pivot about an axis (76) which intersects the cutting point (87) and runs in an X-direction;

at least one drive (71) disposed on the first and the second cutting unit (52, 53) for the displacement of the corner cutting knives (42, 43) by a uniform stroke in a Z-direction through the cutout (41) in the working plate (2) and through the workpiece (31) resting thereon;

at least one drive (66, 67) disposed on each cutting unit (52, 53) for the pivotal adjustment of at least one knife (82, 83) relative to the cutting unit (52, 53); and a control unit for triggering the drives (54, 66, 67, 71).

2. A sewing installation according to claim 1, wherein the at least one pivotally adjustable knife (82, 83) of each cutting unit (52, 53) is mounted on a knife carrier (77, 78) which is lodged pivotally in the cutting unit (52, 53).

3. A sewing installation according to claim 2, wherein the knife carrier (77, 78) is pivotally mounted by means of a curved guide rail (75) and rolls (79, 80, 81) which rest thereon.

4. A sewing installation according to claim 3, wherein the guide rail (75) has the shape of a section of a circular ring and wherein its center of curvature coincides with the axis (76).

5. A sewing installation according to claim 2, wherein the knife carrier (77, 78) is guided for displacement in the Z direction in a guide member (64, 65) of the cutting unit (52, 53).

6. A sewing installation according to claim 2, wherein the drive (71) is connected to the knife carrier (77, 78) via the pivot guide for displacement of the corner cutting knives (42, 43) in the Z-direction.

7. A sewing installation according to claim 3, wherein at least one guide rail (75) is mounted on a support member (74) which is lodged on the cutting unit (52, 53) for displacement in the Z-direction and which is coupled to the drive (71) for the displacement of the corner cutting knives (42, 43) in the Z-direction.

8. A sewing installation according to claim 1, wherein the drive (71) for the displacement of the corner cutting knives (42, 43) in the Z-direction is a fluid-actuated piston-cylinder drive.

9. A sewing installation according to claim 1, wherein the drive (66, 67), which is disposed on each cutting unit (52, 53) for the pivotal adjustment of at least one cutting knife (82, 83), is a stepping motor.

10. A sewing installation according to claim 1, wherein the cutting point (87) is part of an awl (86) which is mounted on the cutting unit (52, 53).

11. A sewing installation according to claim 1, wherein all the knives (82, 83) are pivotally adjustable.

* * * * *